US012352184B2

(12) United States Patent
Love et al.

(10) Patent No.: US 12,352,184 B2
(45) Date of Patent: Jul. 8, 2025

(54) WEAR PAD FOR ROOT OF FAN BLADE

(71) Applicant: RTX Corporation, Farmington, CT (US)

(72) Inventors: Robert Andrew Love, Bloomfield, CT (US); Jiayuan Shen, East Lyme, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 18/388,603

(22) Filed: Nov. 10, 2023

(65) Prior Publication Data

US 2025/0154875 A1 May 15, 2025

(51) Int. Cl.
*F01D 5/30* (2006.01)

(52) U.S. Cl.
CPC ..... *F01D 5/3092* (2013.01)

(58) Field of Classification Search
CPC ..... F01D 5/288; F01D 5/3007; F01D 5/3015; F01D 5/3061; F01D 5/3092; F01D 5/32; F05D 2230/90
See application file for complete search history.

(56) References Cited

U.S. PATENT DOCUMENTS 5,160,243 A * 11/1992 Herzner ..... F01D 5/28 416/500
5,240,375 A * 8/1993 Wayte ..... F01D 5/28 416/248
9,828,861 B2 11/2017 Le Hong
10,087,948 B2 * 10/2018 Drozdenko ..... F04D 29/34
10,273,816 B2 * 4/2019 Abraham ..... F01D 5/3092
10,415,402 B2 9/2019 Murdock et al.
11,591,919 B2 * 2/2023 Palumbo ..... F01D 5/3007
2016/0003067 A1 * 1/2016 Riewe ..... F01D 5/3092 29/889.71

FOREIGN PATENT DOCUMENTS

EP 1764480 A1 3/2007
FR 2951494 A1 4/2011
FR 3121706 A1 10/2022
JP H08326503 A 12/1996
WO WO-2022258257 A1 * 12/2022 ..... F01D 25/005

OTHER PUBLICATIONS

Extended European Search Report for EP Application No. 24212140.8, dated Apr. 16, 2025, pp. 1-8.

* cited by examiner

*Primary Examiner* — David E Sosnowski
*Assistant Examiner* — Jason G Davis
(74) *Attorney, Agent, or Firm* — CANTOR COLBURN LLP

(57) ABSTRACT

A wear pad assembly is provided for a root of a fan blade. The wear pad assembly includes a first tapered side piece including an edge and first and second ends, a second tapered side piece including an edge and first and second ends, a bottom piece extending between the respective edges of the first and second tapered side pieces and including first and second ends and first and second end pieces by which the respective first and second ends of the first and second tapered side pieces are connectable with the first and second ends of the bottom piece, respectively, to form a wear pad having a similar shape as the root.

12 Claims, 7 Drawing Sheets

WEAR PAD FOR ROOT OF FAN BLADE

BACKGROUND

Exemplary embodiments of the present disclosure relate generally to gas turbine engines and, in one embodiment, to a gas turbine engine having a wear pad for a root of a fan blade.

In a gas turbine engine, air is compressed in a compressor and compressor air is then mixed with fuel and combusted in a combustor to produce a high-temperature and high-pressure working fluid. This working fluid is directed into a turbine in which the working fluid is expanded to generate power. The generated power drives the rotation of a rotor within the turbine through aerodynamic interactions between the working fluid and turbine blades or airfoils. The rotor can be used to drive rotations of a propeller or fan or to produce electricity in a generator.

The air that is compressed in the compressor can be drawn into an inlet of the compressor by the propeller or fan. The propeller or fan includes multiple fan blades, each of which includes a root by which each fan blade is attached to a hub. A wear pad can be provided at the root to protect the root from wear and damage but can be difficult to apply.

Accordingly, a need exists for an improved wear pad that is relatively easy to apply to a root of a fan blade.

BRIEF DESCRIPTION

According to an aspect of the disclosure, a wear pad assembly is provided for a root of a fan blade. The wear pad assembly includes a first tapered side piece including an edge and first and second ends, a second tapered side piece including an edge and first and second ends, a bottom piece extending between the respective edges of the first and second tapered side pieces and including first and second ends and first and second end pieces by which the respective first and second ends of the first and second tapered side pieces are connectable with the first and second ends of the bottom piece, respectively, to form a wear pad having a similar shape as the root.

In accordance with additional or alternative embodiments, the wear pad further includes adhesive interposed between the wear pad and the root.

In accordance with additional or alternative embodiments, the wear pad includes material which is adherable to the root.

In accordance with additional or alternative embodiments, the wear pad includes material which is metallurgically bondable to the root.

In accordance with additional or alternative embodiments, there is an absence of root protective coating between a bottom of the root and the bottom piece and the wear pad assembly further includes root protective coating on a bottom thereof.

In accordance with additional or alternative embodiments, the wear pad has a curvature matching a curvature of the root.

In accordance with additional or alternative embodiments, the first and second tapered side pieces, the bottom piece and the first end piece are initially connectable to form a first partial wear pad which is slidable over the root, the second end piece forms a second partial wear pad and, once the first partial wear pad is slid over the root, the second partial wear pad is connectable with the first partial wear pad to form the wear pad.

In accordance with additional or alternative embodiments, the first tapered side piece, a first side portion of the bottom piece and respective first side portions of the first and second end pieces are initially connectable to form a first partial wear pad, the second tapered side piece, a second side portion of the bottom piece and respective second side portions of the first and second end pieces are initially connectable to form a second partial wear pad and the first and second partial wear pads are applicable to and connectable over the root to form the wear pad.

According to an aspect of the disclosure, a method of assembling a wear pad assembly for a root of a fan blade is provided. The method includes forming a first partial wear pad having an open end and a closed end, forming a second partial wear pad, sliding the first partial wear pad over the root with the open end leading until the closed end impinges upon the root and attaching the second partial wear pad to the first partial wear pad to form a wear pad having a similar shape as the root.

In accordance with additional or alternative embodiments, the forming of the first and second partial wear pads is executed such that the wear pad includes a first tapered side piece including an edge and first and second ends, a second tapered side piece including an edge and first and second ends, a bottom piece extending between the respective edges of the first and second tapered side pieces and including first and second ends and first and second end pieces by which the respective first and second ends of the first and second tapered side pieces are connected with the first and second ends of the bottom piece, respectively.

In accordance with additional or alternative embodiments, the method further includes applying adhesive to the root prior to the sliding and the attaching.

In accordance with additional or alternative embodiments, the method further includes adhering a material of the wear pad onto the root.

In accordance with additional or alternative embodiments, the method further includes metallurgically bonding a material of the wear pad to the root.

In accordance with additional or alternative embodiments, the method further includes applying a root protective coating to a bottom of the wear pad.

According to an aspect of the disclosure, a method of assembling a wear pad assembly for a root of a fan blade is provided. The method includes forming a first partial wear pad, forming a second partial wear pad, applying the first and second partial wear pads onto root in opposite directions and connecting the first and second wear pads over the root to form a wear pad having a similar shape as the root.

In accordance with additional or alternative embodiments, the forming of the first and second partial wear pads is executed such that the wear pad includes a first tapered side piece including an edge and first and second ends, a second tapered side piece including an edge and first and second ends, a bottom piece extending between the respective edges of the first and second tapered side pieces and including first and second ends and first and second end pieces by which the respective first and second ends of the first and second tapered side pieces are connected with the first and second ends of the bottom piece, respectively.

In accordance with additional or alternative embodiments, the method further includes applying adhesive to the root prior to the applying and the connecting.

In accordance with additional or alternative embodiments, the method further includes adhering a material of the wear pad onto the root.

In accordance with additional or alternative embodiments, the method further includes metallurgically bonding a material of the wear pad to the root.

In accordance with additional or alternative embodiments, the method further includes applying a root protective coating to a bottom of the wear pad.

These and other advantages and features will become more apparent from the following description taken in conjunction with the drawings.

BRIEF DESCRIPTION OF THE DRAWINGS

The following descriptions should not be considered limiting in any way. With reference to the accompanying drawings, like elements are numbered alike.

These and other advantages and features will become more apparent from the following description taken in conjunction with the drawings.

DETAILED DESCRIPTION

A detailed description of one or more embodiments of the disclosed apparatus and method are presented herein by way of exemplification and not limitation with reference to the Figures.

Figure 1:
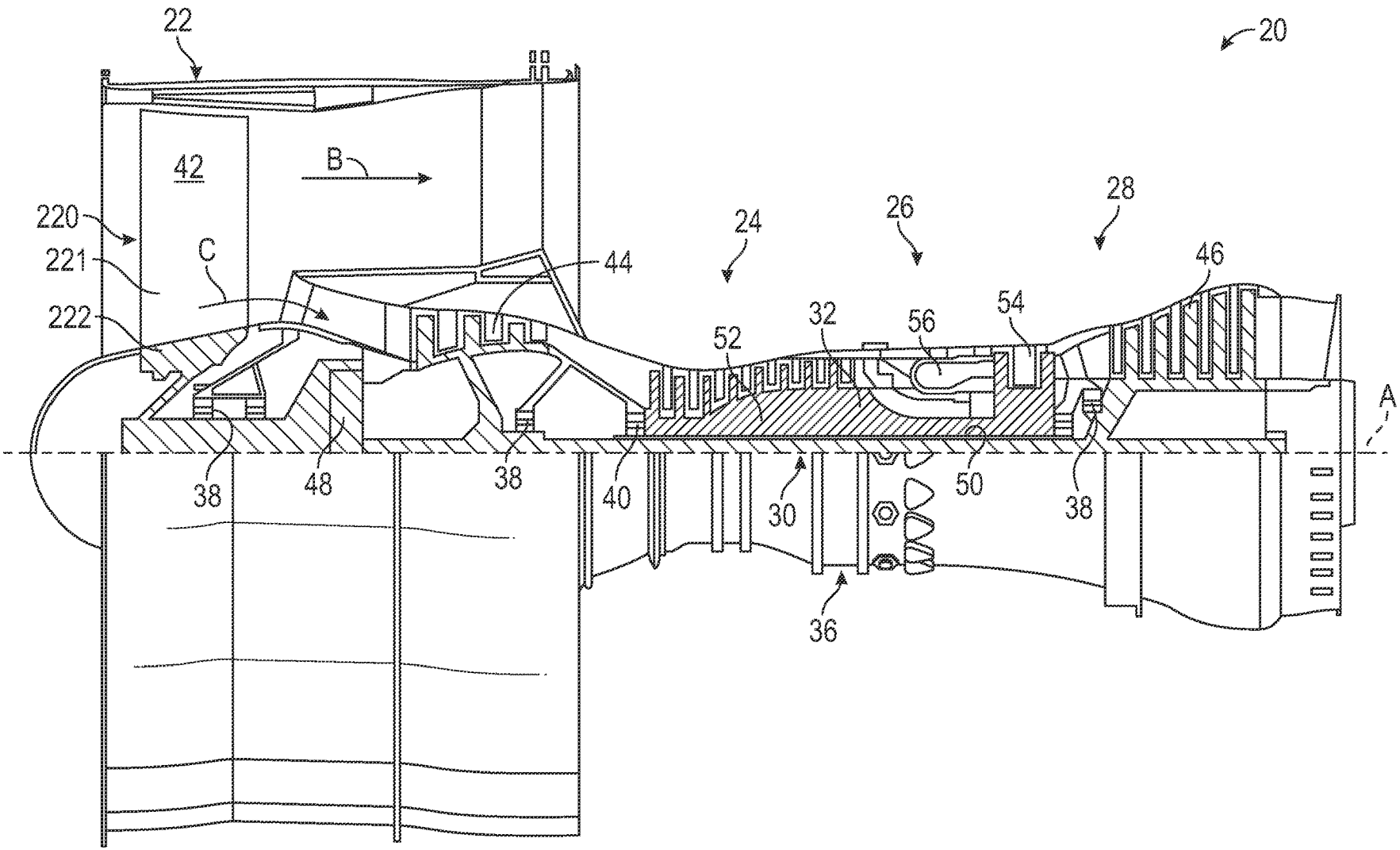
FIG. 1 is a partial cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include other systems or features. The fan section 22 drives air along a bypass flow path B in a bypass duct, while the compressor section 24 drives air along a core flow path C for compression and communication into the combustor section 26 and then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary gas turbine engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in the gas turbine engine 20 between the high pressure compressor 52 and the high pressure turbine 54. The engine static structure 36 is arranged generally between the high pressure turbine 54 and the low pressure turbine 46. The engine static structure 36 further supports the bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 and then the high pressure compressor 52, is mixed and burned with fuel in the combustor 56 and is then expanded over the high pressure turbine 54 and the low pressure turbine 46. The high and low pressure turbines 54 and 46 rotationally drive the low speed spool 30 and the high speed spool 32, respectively, in response to the expansion. It will be appreciated that each of the positions of the fan section 22, compressor section 24, combustor section 26, turbine section 28, and fan drive gear system 48 may be varied. For example, geared architecture 48 may be located aft of the combustor section 26 or even aft of the turbine section 28, and the fan section 22 may be positioned forward or aft of the location of geared architecture 48.

Figure 2:
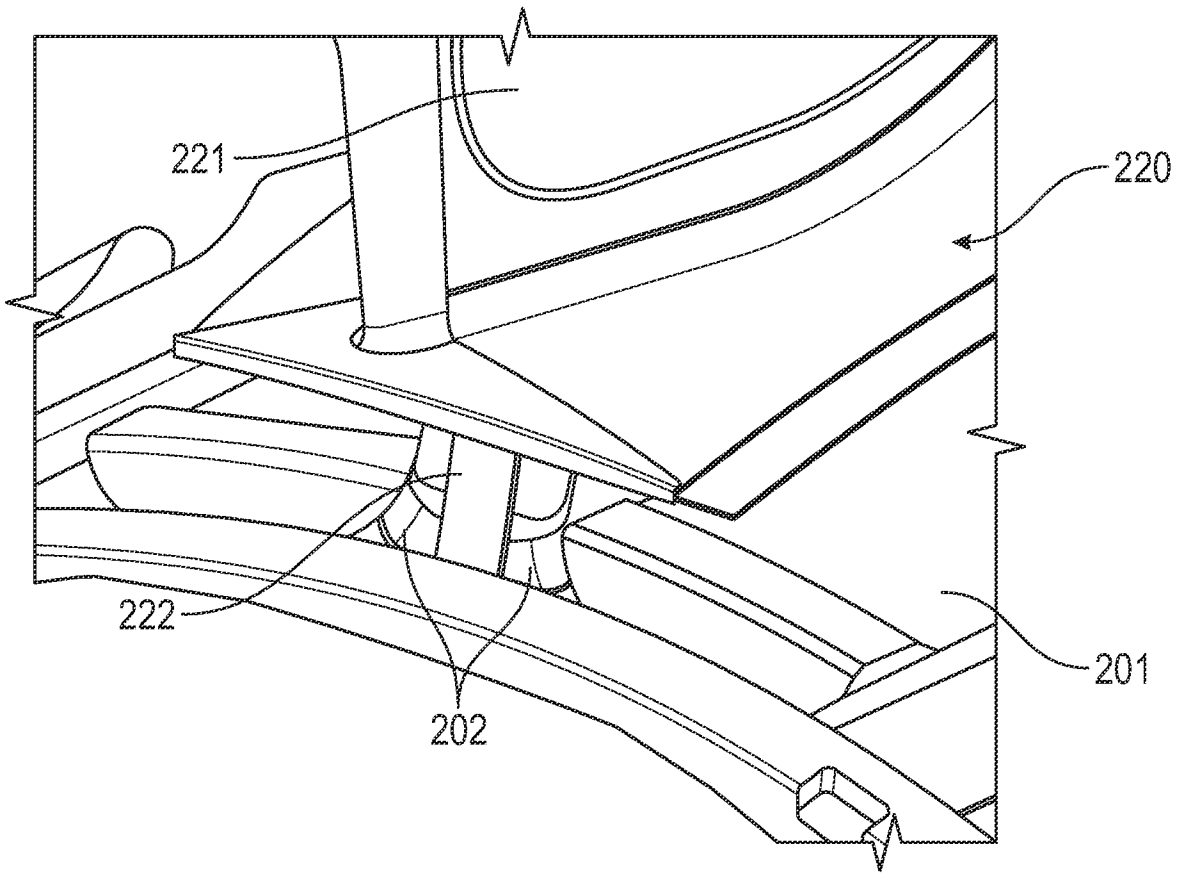
FIG. 2 is a perspective view of a fan blade of the gas turbine engine of FIG. 1.

With continued reference to FIG. 1 and with additional reference to FIG. 2, the air that is compressed in the compressor section 24 can be drawn into an inlet of the compressor section 24 by the fan 42. The fan 42 includes multiple fan blades 220, each of which includes an airfoil section 221 and a root 222. Each of the fan blades 220 is attached to a hub 201 of the fan 42 at the root 222. For each of the fan blades 220, a wear pad 202 can be provided at the root 222 to protect the root 222 from wear and damage. It has been found, however, that conventional forms of the wear pads 202 can be difficult to apply to the roots 222.

Presently, the wear pads 202 have to be manually attached. For a given wear pad 202, the wear pad 202 starts in a flattened shape and must be formed as a part of the assembly process. This process includes placing tabs in place on the corresponding root 422 with nothing to guide for alignment. Any gap around the wear pad 202 are filled with additional treatments to protect the underlying surfaces and to protect edges of the wear pad 202. In some cases, an additional root treatment follows the manual attachment of the wear pad 202 to provide wear protection to the bottom of the corresponding fan blade 420.

Accordingly, a need exists for an improved wear pad that is relatively easy to apply to a root of a fan blade of a gas turbine engine.

Therefore, as will be described below, a fabric resin composite is formed to the shape of a blade root in one or multiple pieces to thus form a preformed wear pad. The shape of the preformed wear pad allows for better alignment of the wear pad with the root of the fan blade with which the wear pad is going to be mated and improves the assembly process. The wear pad (in one or multiple pieces) subsequently encapsulates the root and reduces or eliminates gaps that require fillers. The wear pad (in one or multiple pieces)

can also cover the bottom surface of the root and eliminates any need for additional treatments.

Figure 3:
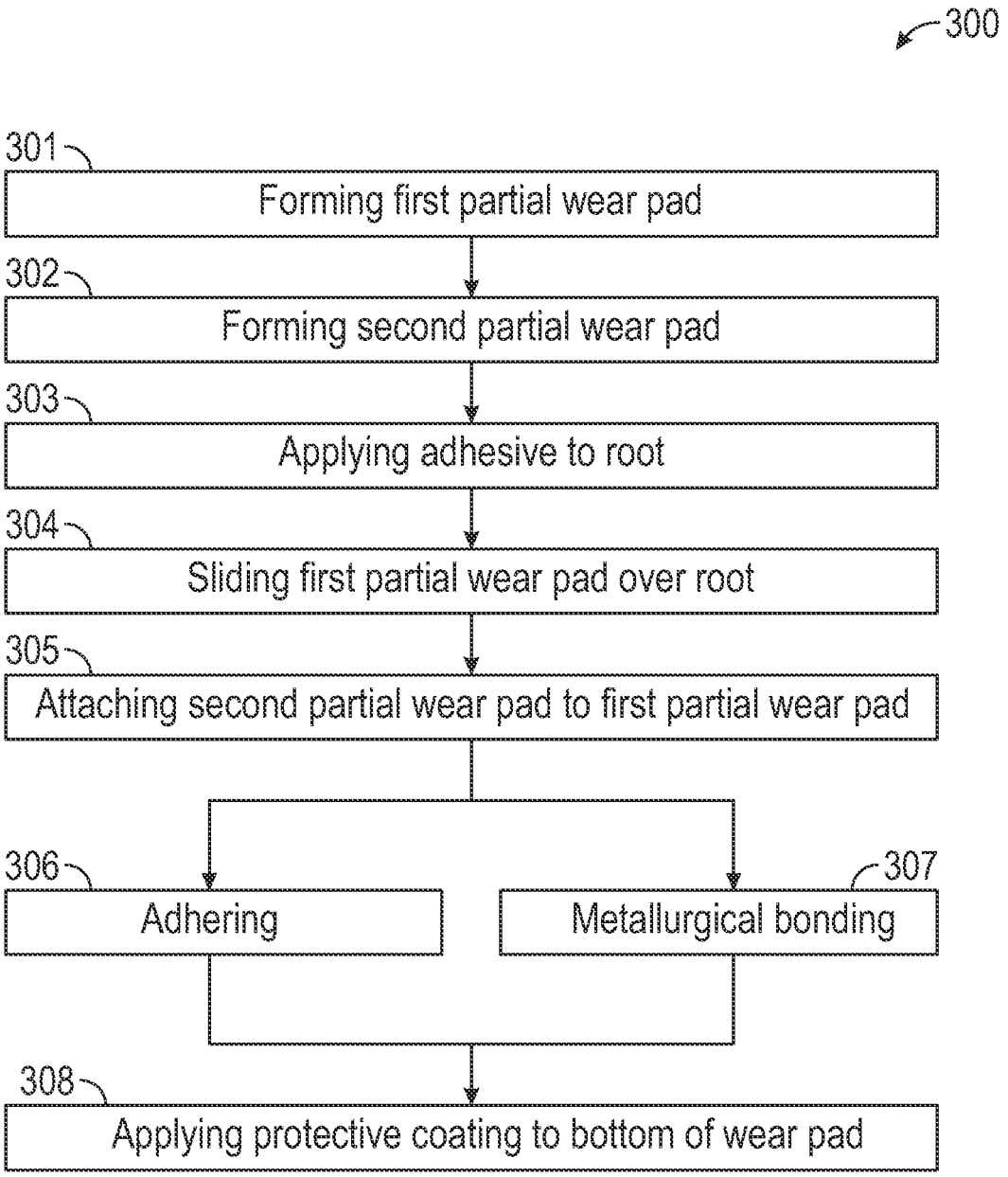
FIG. 3 is a flow diagram illustrating a method of assembling a wear pad assembly for a root of a fan blade in accordance with embodiments.
Figure 4:
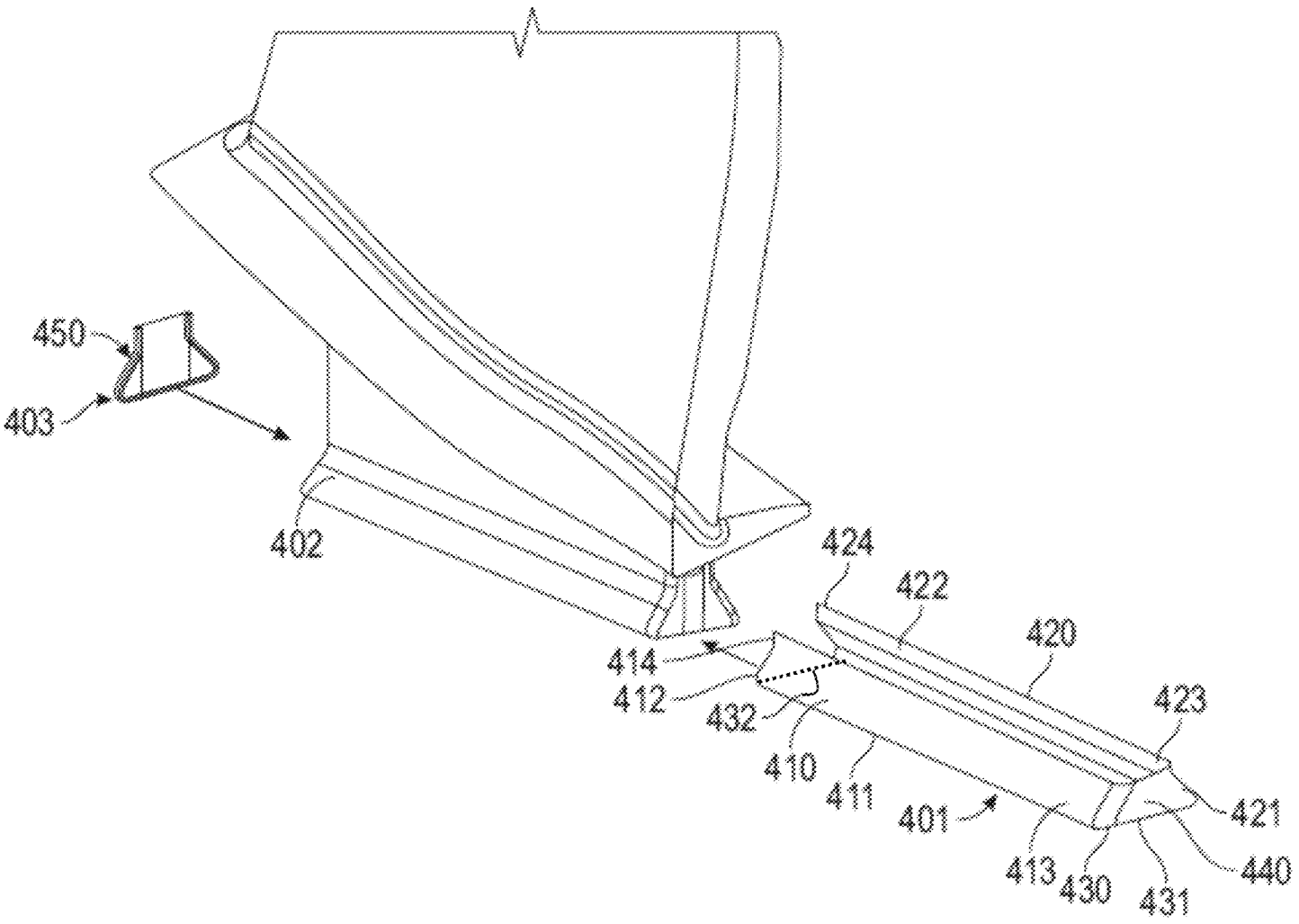
FIG. 4 is a graphical illustration of the method of FIG. 3 in accordance with embodiments.

With reference to FIGS. 3 and 4, a method 300 of assembling a wear pad assembly is provided for a root of a fan blade, such as root 222 of fan blade 220 of FIGS. 1 and 2. As shown in FIG. 3, the method 300 includes forming a first partial wear pad having an open end and a closed end (block 301), forming a second partial wear pad (block 302), sliding the first partial wear pad over the root with the open end leading until the closed end impinges upon the root (block 304) and attaching the second partial wear pad to the first partial wear pad to form a wear pad having a similar shape as the root (block 305).

In accordance with embodiments, the method 300 can further include applying adhesive to the root prior to the sliding and the attaching of blocks 304 and 305 (block 303). In addition, the method 300 can include at least one of adhering the wear pad onto the root (block 306) using an adhesive bond or glue and, in some cases in which the wear pad is metallic, metallurgically bonding a material of the wear pad to the root (block 307) or some other similar bonding method. As an additional option, the method 300 can also include not applying root protective coating to a bottom of the root and applying a root protective coating to a bottom of the wear pad (block 308).

As shown graphically and illustratively in FIG. 4, the forming of the first and second partial wear pads of blocks 301 and 302 are executed such that the wear pad ultimately includes a first tapered side piece 410, a second tapered side piece 420, a bottom piece 430 and first and second end pieces 440 and 450. The first tapered side piece 410 includes an edge 411, first and second ends 412 and 413 and an untapered flange 414 that extends radially outwardly off of an outboard edge of the first tapered side piece 410. The second tapered side piece 420 includes an edge 421, first and second ends 422 and 423 and an untapered flange 424 that extends radially outwardly off of an outboard edge of the second side piece 420. The bottom piece 430 extends between the respective edges 411 and 421 of the first and second tapered side pieces 410 and 420 and includes first and second ends 431 and 432. The first end piece 440 serves to connect the respective first ends 412 and 422 of the first and second tapered side pieces 410 and 420 with the first end 431 of the bottom piece 430. The second end piece 450 serves to connect the respective second ends 413 and 423 of the first and second tapered side pieces 410 and 420 with the second end 432 of the bottom piece 430.

Although FIG. 4 is illustrated with the first partial wear pad 401 having a longitudinal length that is a significant fraction of a corresponding longitudinal length of the root 402 and the second partial wear pad 403 effectively caps the first partial wear pad 401 to form the wear pad (see FIGS. 7 and 8), this configuration and arrangement is not required. For example, alternative embodiments exist in which the first partial wear pad 401 has a fractional longitudinal length of the root 402 and the second partial wear pad 403 has first and second tapered side pieces, a bottom piece and an end piece all of which are similar to those described above and a longitudinal length that is a remainder of the longitudinal length of the root 402. In these or other cases, the first and second partial wear pads 401 and 403 can each be slid over opposite ends of the root to meet at a mid-point of the root 402. In any case, an internal shape of the wear pad can be substantially similar to or the same as an external shape of the root 402.

Figure 5:
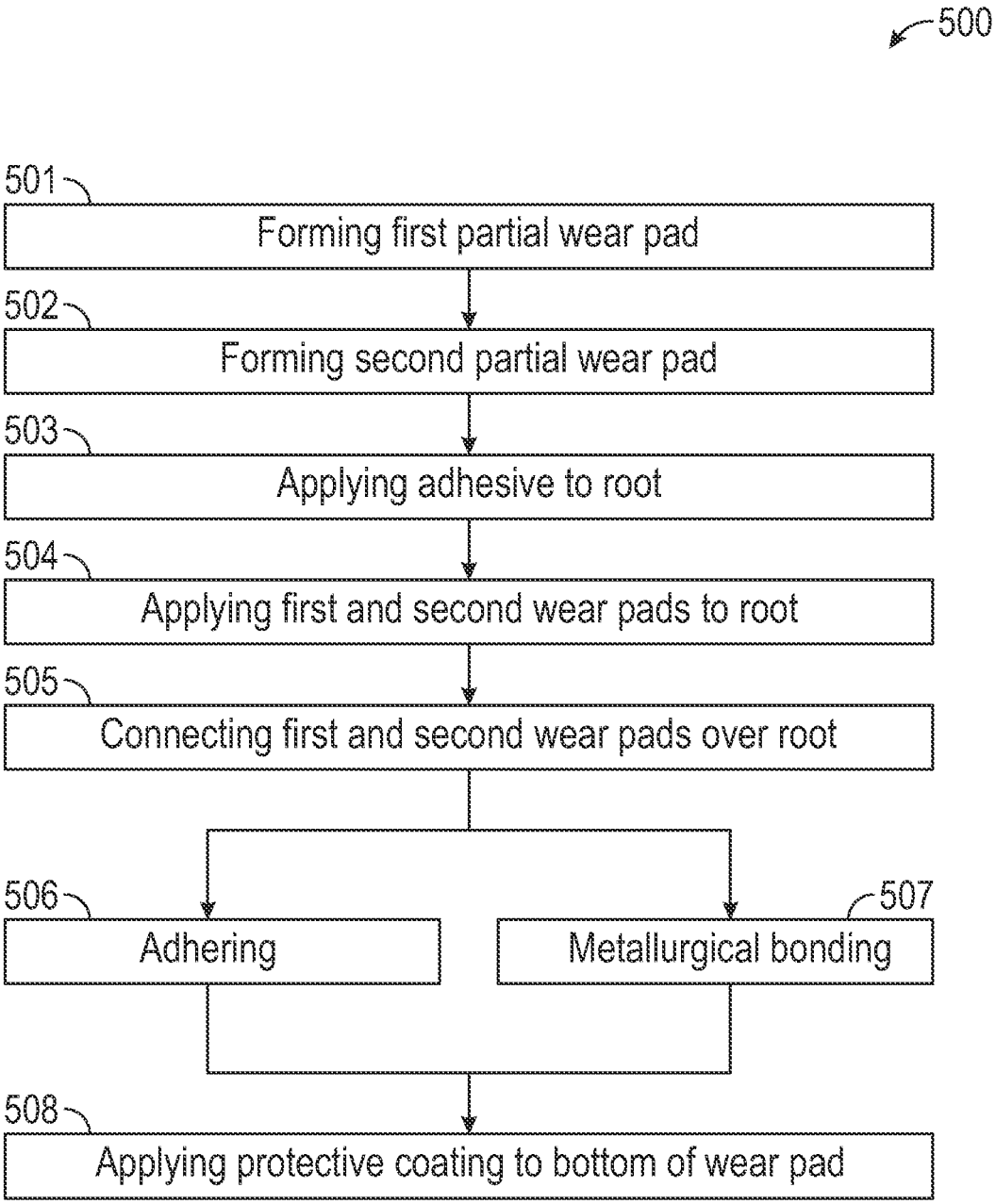
FIG. 5 is a flow diagram illustrating a method of assembling a wear pad assembly for a root of a fan blade in accordance with embodiments.
Figure 6:
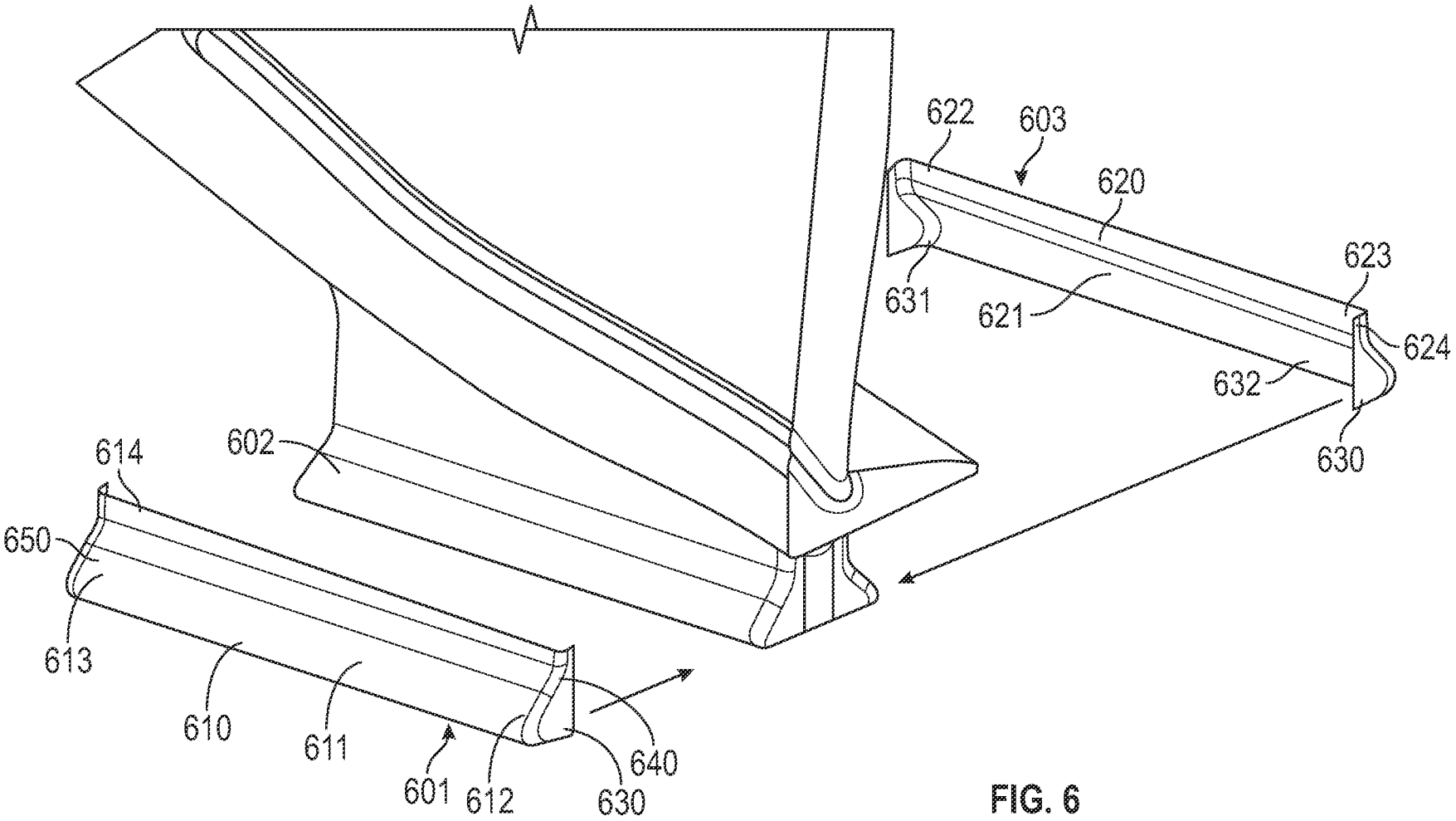
FIG. 6 is a graphical illustration of the method of FIG. 5 in accordance with embodiments.

With reference to FIGS. 5 and 6, a method 500 of assembling a wear pad assembly is provided for a root of a fan blade, such as root 222 of fan blade 220 of FIGS. 1 and 2. As shown in FIG. 5, the method 500 includes forming a first partial wear pad (block 501), forming a second partial wear pad (block 502), applying the first and second partial wear pads onto root in opposite directions (block 504) and connecting the first and second wear pads over the root to form a wear pad having a similar shape as the root (block 505).

In accordance with embodiments, the method 500 can further include applying adhesive to the root prior to the applying and connecting of blocks 504 and 505 (block 503). In addition, the method 500 can include at least one adhering the wear pad onto the root (block 506) using an adhesive bond or glue and, in some cases in which the wear pad is metallic, metallurgically bonding a material of the wear pad to the root (block 507) or some other similar bonding method. As an additional option, the method 500 can also include not applying root protective coating to a bottom of the root and applying a root protective coating to a bottom of the wear pad (block 508).

As shown graphically and illustratively in FIG. 6, the forming of the first and second partial wear pads of blocks 501 and 502 are executed such that the wear pad ultimately includes a first tapered side piece 610, a second tapered side piece 620, a bottom piece 630 and first and second end pieces 640 and 650. The first tapered side piece 610 includes an edge 611, first and second ends 612 and 613 and an untapered flange 614 that extends radially outwardly off of an outboard edge of the first tapered side piece 610. The second tapered side piece 620 includes an edge 621, first and second ends 622 and 623 and an untapered flange 624 that extends radially outwardly off of an outboard edge of the second side piece 620. The bottom piece 630 extends between the respective edges 611 and 621 of the first and second tapered side pieces 610 and 620 and includes first and second ends 631 and 632. The first end piece 640 serves to connect the respective first ends 612 and 622 of the first and second tapered side pieces 610 and 620 with the first end 631 of the bottom piece 630. The second end piece 650 serves to connect the respective second ends 613 and 623 of the first and second tapered side pieces 610 and 620 with the second end 632 of the bottom piece 630.

Although FIG. 6 is illustrated with the first and second partial wear pads 601 and 603 being substantially half-portions of the root 602 to form the wear pad (see FIGS. 7 and 8), this configuration and arrangement is not required. For example, alternative embodiments exist in which the first partial wear pad 601 extends nearly all of the way around the root 602 and the second partial wear pad 603 essentially caps the first partial wear pad 601 or vice versa. In any case, an internal shape of the wear pad can be substantially similar to or the same as an external shape of the root 602.

Figure 7:
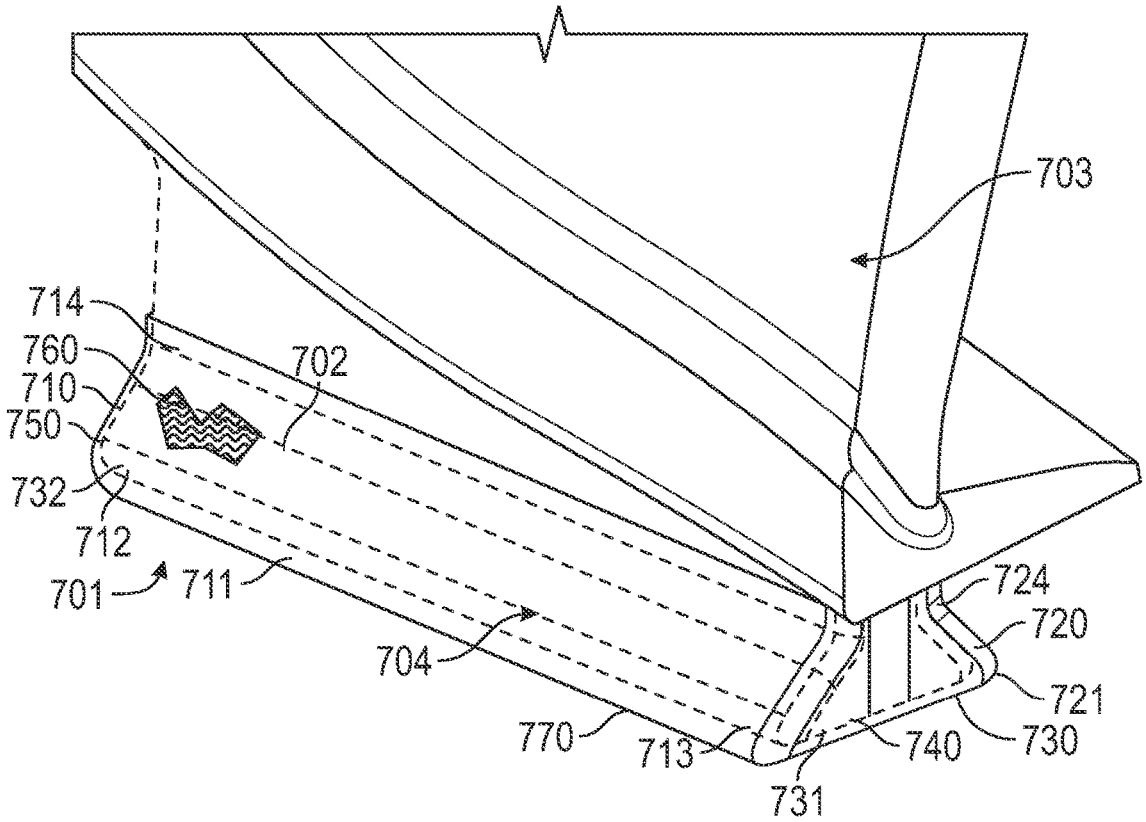
FIG. 7 is a perspective view of a wear pad assembly for a root of a fan blade in accordance with embodiments.
Figure 8:
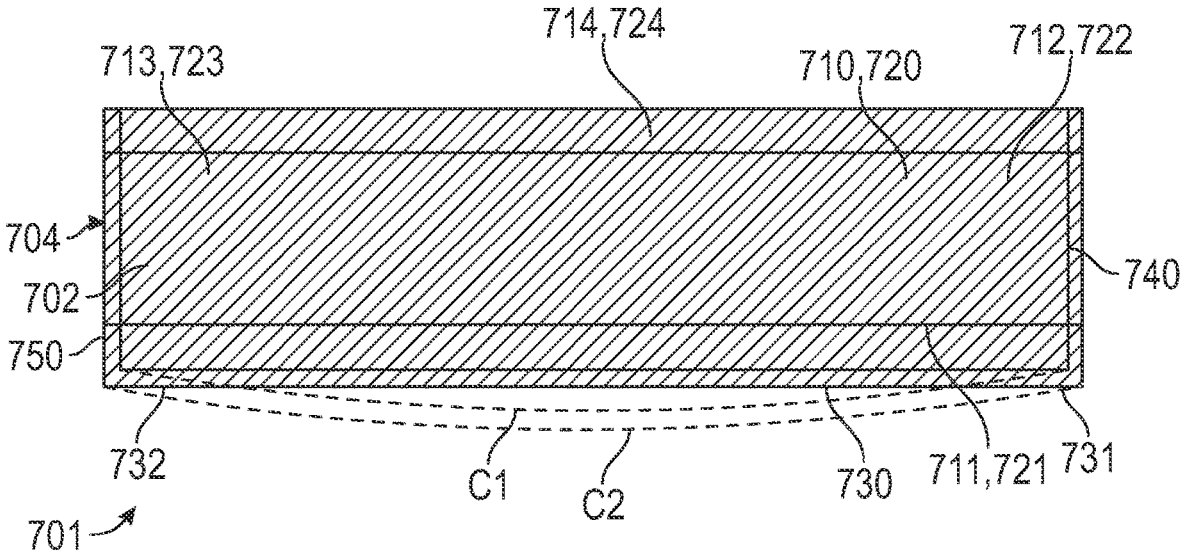
FIG. 8 is a side view of the wear pad assembly of FIG. 7 in accordance with embodiments.

With reference to FIGS. 7 and 8, a wear pad assembly 701 is provided for a root 702 of a fan blade 703, such as root 222 of fan blade 220 of FIGS. 1 and 2. As shown in FIGS. 7 and 8, the wear pad assembly 701 includes a first tapered side piece 710 including an edge 711 and first and second ends 712 and 713, a second tapered side piece 720 including an edge 721, first end 722 (see FIG. 8) and second end 723, a bottom piece 730 extending between the respective edges 711 and 721 of the first and second tapered side pieces 710 and 720 and including first and second ends 731 and 732 and first and second end pieces 740 and 750. The first tapered side piece 710 can further include an untapered flange 714 that extends radially outwardly off of an outboard edge of the first tapered side piece 710. The second tapered side piece 720 can further include an untapered flange 724 that extends radially outwardly off of an outboard edge of the second tapered side piece 720. The respective first ends 711 and 721 of the first and second tapered side pieces 710 and 720 are connectable with the first end 731 of the bottom piece 730 by way of the first end piece 740. The respective second ends 712 and 722 of the first and second tapered side pieces 710 and 720 are connectable with the second end 732 of the bottom piece 730 by way of the second end piece 750. With all components connected as described above, a wear pad 704 is formed to have a similar shape as the root 702 and, in some but not all cases, an interior shape that is substantially similar to or the same as an exterior shape of the root 702.

In accordance with embodiments, the wear pad assembly 701 can further include adhesive 760 interposed between the wear pad 704 and the root 702. Additionally or alternatively, the wear pad 704 can include material which can be adhered to the root 702 and, in some cases, metallic material which is metallurgically bondable to the root 702. There can be an absence of root protective coating between a bottom of the root 702 and the bottom piece 730 and the wear pad assembly 701 can further include root protective coating 770 on a bottom thereof. In accordance with further embodiments, in cases in which the root 702 has a curvature C1, the wear pad 704 can have a similar or matching curvature C2 (see FIG. 8).

With the configuration described above, the first and second tapered side pieces 710 and 720, the bottom piece 730 and the first end piece 740 are initially connectable to form a first partial wear pad which is slidable over the root 702, the second end piece 750 can form a second partial wear pad and, once the first partial wear pad is slid over the root 702, the second partial wear pad is connectable with the first partial wear pad to form the wear pad 704 (see FIGS. 3 and 4). Alternatively, the first tapered side piece 710, a first side portion of the bottom piece 730 and respective first side portions of the first and second end pieces 740 and 750 are initially connectable to form a first partial wear pad, the second tapered side piece 720, a second side portion of the bottom piece 730 and respective second side portions of the first and second end pieces 740 and 750 are initially connectable to form a second partial wear pad and the first and second partial wear pads are applicable to and connectable over the root 702 to form the wear pad 704.

Benefits of the features described herein are the provision of a preformed wear pad and the elimination of wear pad formation during blade assembly. In addition, the preformed wear pad allows for improved alignment and reduced rework, reduced cost, removal of protective coating at a bottom of a root of a fan blade, less need for gap filler around conventional wear pads, fewer exposed corners that are susceptible to wear, reductions in field replacements and reductions in de-bonding.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A wear pad assembly for a root of a fan blade, the wear pad assembly comprising prior to assembly to the root:

an initial unitary component comprising:

a first tapered side piece comprising an edge and first and second ends;

a second tapered side piece comprising an edge and first and second ends;

a bottom piece extending between the respective edges of the first and second tapered side pieces and comprising first and second ends; and a first end piece by which the first ends of the first and second tapered side pieces are connected with the first end of the bottom piece; and an additional component separate from the initial unitary component and comprising:

a second end piece by which the second ends of the first and second tapered side pieces are connectable with the second end of the bottom piece, wherein the additional component is connectable with the initial unitary component to form a wear pad having a similar shape as the root.

2. The wear pad assembly according to claim 1, further comprising adhesive interposable between the wear pad and the root.

3. The wear pad assembly according to claim 1, wherein the wear pad comprises material which is adherable to the root.

4. The wear pad assembly according to claim 1, wherein the wear pad comprises material which is metallurgically bondable to the root.

5. The wear pad assembly according to claim 1, wherein the wear pad assembly further comprises root protective coating on a bottom thereof.

6. The wear pad assembly according to claim 1, wherein the wear pad has a curvature matching a curvature of the root.

7. The wear pad assembly according to claim 1, wherein:

the first and second tapered side pieces, the bottom piece and the first end piece are initially connectable to form the initial unitary component as a first partial wear pad which is slidable over the root, the second end piece of the additional component forms a second partial wear pad, and, with the first partial wear pad being slidable over the root, the second partial wear pad is connectable with the first partial wear pad to form the wear pad.

8. A method of assembling a wear pad assembly for a root of a fan blade, the method comprising:

forming a first partial wear pad having an open end and a closed end;

forming a second partial wear pad;

sliding the first partial wear pad over the root with the open end leading until the closed end impinges upon a first end of the root and the open end substantially aligns with a second end of the root opposite the first end of the root; and attaching, at the second end of the root, corresponding edges of the second partial wear pad to corresponding edges of the first partial wear pad to form a wear pad having a similar shape as the root, wherein the forming of the first partial wear pad is executed such that the first partial wear pad comprises:

a first tapered side piece comprising an edge and first and second ends;

a second tapered side piece comprising an edge and first and second ends;

a bottom piece extending between the respective edges of the first and second tapered side pieces and comprising first and second ends; and a first end piece by which the first ends of the first and second tapered side pieces are connected with the first end of the bottom piece, and wherein the forming of the second partial wear pad is executed such that the second partial wear pad comprises a second end piece by which the second ends of the first and second tapered side pieces are connectable with the second end of the bottom piece.

9. The method according to claim 8, further comprising applying adhesive to the root prior to the sliding and the attaching.

10. The method according to claim 8, further comprising adhering a material of the wear pad onto the root.

11. The method according to claim 8, further comprising metallurgically bonding a material of the wear pad to the root.

12. The method according to claim 8, further comprising applying a root protective coating to a bottom of the wear pad.

* * * * *